US011358108B2

(12) United States Patent
Wang et al.

(10) Patent No.: US 11,358,108 B2
(45) Date of Patent: Jun. 14, 2022

(54) INNER CORE ASSEMBLY AND VIBRATION MIXER

(71) Applicant: ZHENGZHOU SANHUA TECHNOLOGY & INDUSTRY CO., LTD., Henan (CN)

(72) Inventors: Junlong Wang, Henan (CN); Yaobin Xue, Henan (CN)

(73) Assignee: ZHENGZHOU SANHUA TECHNOLOGY & INDUSTRY CO., LTD., Henan (CN)

( * ) Notice: Subject to any disclaimer, the term of this patent is extended or adjusted under 35 U.S.C. 154(b) by 88 days.

(21) Appl. No.: 16/823,852

(22) Filed: Mar. 19, 2020

(65) Prior Publication Data

US 2020/0298190 A1 Sep. 24, 2020

(30) Foreign Application Priority Data

| | | |
|---|---|---|
| Mar. 20, 2019 | (CN) | 201910214101.1 |
| Mar. 20, 2019 | (CN) | 201910214717.9 |
| Mar. 20, 2019 | (CN) | 201920357169.0 |
| Mar. 20, 2019 | (CN) | 201920357174.1 |
| Mar. 20, 2019 | (CN) | 201920358051.X |

(51) Int. Cl.
*B01F 31/60* (2022.01)
*B01F 31/24* (2022.01)
(Continued)

(52) U.S. Cl.
CPC ..... *B01F 31/60* (2022.01); *B01F 31/24* (2022.01); *B01F 31/70* (2022.01); *B01F 35/423* (2022.01)

(58) Field of Classification Search
CPC ..... B01F 11/0094; B01F 11/0022; B01F 11/0097; B01F 15/00753; B01F 11/0031; B01F 13/04; B01F 31/60; B01F 31/24; B01F 31/70; B01F 35/423; B01F 35/60; B01F 31/265
(Continued)

(56) References Cited

U.S. PATENT DOCUMENTS 4,134,689 A * 1/1979 Ahrenskou-Sorensen ..... B01F 15/00753 366/110
4,842,415 A * 6/1989 Cane ..... B01F 11/0005 366/110
(Continued)

FOREIGN PATENT DOCUMENTS

| | | | |
|---|---|---|---|
| CN | 2772611 | Y | 4/2006 |
| CN | 202528756 | U | 11/2012 |
| EP | 2377602 | A1 * | 10/2011 |

*Primary Examiner* — Charles Cooley
(74) *Attorney, Agent, or Firm* — Hamre, Schumann, Mueller & Larson, P.C.

(57) ABSTRACT

An inner core assembly for a vibration mixer, includes a motor assembly and a compression assembly located above the motor assembly, wherein the motor assembly comprises a vibration motor, a rotor shaft of the vibration motor is connected to the compression assembly by using an eccentric structure, the compression assembly comprises a stage, the stage is connected to a pressure plate mounting bracket by using a guiding shaft, the pressure plate mounting bracket is capable of sliding along the guiding shaft, the rotor shaft of the vibration motor rotates and drives, by using the eccentric structure, the compression assembly to perform reciprocating motion.

12 Claims, 14 Drawing Sheets

(51) Int. Cl.
*B01F 31/00* (2022.01)
*B01F 35/42* (2022.01)

(58) Field of Classification Search
USPC ..... 366/209, 212
See application file for complete search history.

(56) References Cited

U.S. PATENT DOCUMENTS 5,066,136 A * 11/1991 Johnson ..... B01F 15/00733 366/209
5,268,620 A * 12/1993 Hellenberg ..... B01F 11/00 318/114
5,458,416 A * 10/1995 Edwards ..... B01F 15/00753 366/209
5,462,353 A * 10/1995 Gatlin ..... B01F 11/0005 366/209
5,906,433 A * 5/1999 Mazzalveri ..... B01F 9/0018 366/209
2004/0008573 A1* 1/2004 MacDonald ..... B01F 15/00753 366/209
2004/0202045 A1* 10/2004 Marazzi ..... B25B 1/24 366/209
2007/0211561 A1* 9/2007 Page ..... B01F 15/00753 366/113
2020/0298190 A1* 9/2020 Wang ..... B01F 11/0097

* cited by examiner

INNER CORE ASSEMBLY AND VIBRATION MIXER

FIELD OF TECHNOLOGY

The present invention relates to the industry of paint mixing and color matching, and specifically, to an inner core assembly and a vibration mixer.

BACKGROUND

At present, a structure of a vibratory mixer used for paint mixing and color matching on the market includes a housing assembly and a main frame assembly. The patent application number is CN200520030311.9. The main frame assembly shown in FIG. 1 includes an inner frame assembly 1', a middle frame assembly 2', an outer frame assembly 3', a vibration reduction spring assembly, a mixing motor, and the like. In the inner frame assembly, a motor drives a lead screw to drive a pressure plate to move up and down, to compress and open a color paste bucket. A bearing on an eccentric main shaft assembly in the inner frame assembly is connected to a middle frame. The mixing motor fixed on the middle frame drives, by using a belt, an eccentric main shaft to rotate. Eccentric shafts at both ends of the eccentric main shaft drive a lower portion of the inner frame assembly to rotate up and down and back and forth, to mix pastes in the paste bucket.

Such a vibratory mixer is a universal mixer, and can be applied to paste buckets of all specifications below 20 L. In order to fit paste buckets of 20 L, the main frame assembly is relatively high and an area of a stage is relatively large. However, for small paste buckets below 5 L, the device has large external dimensions, covers a large area, and has high transportation costs. This device appears to be underemployed.

In addition, the application number of the Chinese patent "COLOR PASTE BUCKET FIXING AND COMPRESSING APPARATUS APPLICABLE TO DOUBLE-ROTATION MIXER" is CN201220189997.6. Although a structure of a cam and lock pieces is added to the patent based on the Chinese patent CN200920089170.6, cooperation between the lock pieces and a V-shaped groove of a guiding shaft is not changed. Although an arc-shaped surface at a front end of the lock piece squeezing the V-shaped groove can well lock a pressure plate mounting bracket, machining precision of a structure of the V-shaped groove is difficult to achieve. Consequently, an ideal locking effect cannot be achieved during use.

SUMMARY

For the foregoing technical problems, an objective of the present invention is to provide an inner core assembly and a vibration mixer that have low costs and a small volume.

Technical solutions of the present invention are specifically as follows:

An inner core assembly for a vibration mixer, comprising a motor assembly and a compression assembly located above the motor assembly, wherein the motor assembly comprises a vibration motor, a rotor shaft of the vibration motor is connected to the compression assembly by using an eccentric structure, the compression assembly comprises a stage, the stage is connected to a pressure plate mounting bracket by using a guiding shaft, the pressure plate mounting bracket is capable of sliding along the guiding shaft, the rotor shaft of the vibration motor rotates and drives, by using the eccentric structure, the compression assembly to perform reciprocating motion.

The eccentric structure is an eccentric block, two ends of the rotor shaft of the vibration motor are both connected to the eccentric block, the eccentric block is connected to an outer spherical bearing with a vertical seat by using an eccentric pin shaft, the stage is connected to the outer spherical bearing with the vertical seat, the guiding shaft is connected to the pressure plate mounting bracket, an upper pressure plate is disposed above the stage, and the upper pressure plate is fixed on the pressure plate mounting bracket.

The motor assembly further comprises a motor fixing plate, the vibration motor is fixed on the motor fixing plate, a vibration reduction column is fixed at each vertex of the motor fixing plate, a vibration reduction support is fixed at an upper end of the vibration reduction column, the vibration reduction support is connected to a vibration reduction assembly, the vibration reduction assembly is fixed on a base assembly, a connecting plate is fixed above the pressure plate mounting bracket, a connecting rod is fixed at each of two ends of a connecting plate, two connecting rods are connected to an upper end portion of a rear connecting rod by using a connecting rod fixing plate, a lower end portion of the rear connecting rod is fixed on the vibration reduction column by using a connecting rod bracket.

The vibration reduction assembly comprises a vibration reduction pressure spring, a guiding column is sleeved in the vibration reduction pressure spring, an upper end of the guiding column is fixed on the vibration reduction support by using a bolt, a bearing at a lower end of the guiding column is connected to a pressure spring seat, a bolt of the pressure spring seat is connected to a lower vibration reduction fulcrum bearing, and the lower vibration reduction fulcrum bearing is fixed on the base assembly.

The base assembly is a quadrangular frame structure formed by connecting metal pipes, the base assembly is disposed on the ground by using machine feet, at least one clump weight block is fixedly disposed on the base assembly, and the motor fixing plate is located in the quadrangular frame of the base assembly.

A lock pieces and a cam are clamped in the pressure plate mounting bracket, the lock pieces are symmetrically disposed on two sides of the cam, the pressure plate mounting bracket is connected to the guiding shaft, teeth are provided on the guiding shaft, one end of the lock piece is disposed towards the cam, and the other end coordinates with the teeth of the guiding shaft.

The teeth on the guiding shaft are triangle sawteeth, and an angle $\alpha$ of the triangle sawtooth is 70° to 80°.

The lock piece has an end I and an end II, the end I is provided with an arc-shaped surface and is disposed towards the cam, the end II coordinates with the teeth, the lock piece close to a side of the end I is connected to a lock piece spring, the lock piece close to a side of the end II is connected to the pressure plate mounting bracket by using a pin shaft.

The cam extends upwards and to two sides to form a convex edge, a cam shaft penetrates through the cam, the cam shaft is fixed on the pressure plate mounting bracket, a cam handle is connected to the cam in a vertical direction of the cam shaft, the cam handle is clamped between two oppositely disposed clamp spring plates, and the clamp spring plates are fixed on an upper pressure plate.

The inner core assembly comprises a motor assembly and a compression assembly located above the motor assembly, wherein the motor assembly comprises a vibration motor, a rotor shaft of the vibration motor is connected to the compression assembly by using an eccentric structure, the compression assembly comprises a stage, the stage is connected to a pressure plate mounting bracket by using a guiding shaft, the pressure plate mounting bracket is capable of sliding along the guiding shaft, the rotor shaft of the vibration motor rotates and drives, by using the eccentric structure, the compression assembly to perform reciprocating motion.

The housing assembly comprises side plates located on two sides, the side plate is connected to a side door on a corresponding side by using a side door assembly, a lock lug of an electric lock is fixed on the side door assembly, the electric lock is fixed on the side plates, a lock tongue is disposed on the electric lock, the lock tongue coordinates with the lock lug of the electric lock, a lower baffle is disposed under the side door, and a lower baffle pad is fixedly connected to the lower baffle.

The side door assembly comprises double-door supports, the double-door supports are fixed on both the side door and the side plates, a U-shaped swing door connecting rod and an L-shaped support bar are connected between the two double-door supports, the two double-door supports are connected to each of the swing door connecting rod and the support bar in a parallelogram mechanism, two swing door connecting rods are disposed on two sides of the support bar, and the swing door connecting rod close to the side door is fixedly connected to the lock lug of the electric lock.

The electric lock comprises a lock case, an electromagnet is disposed in the lock case, the electromagnet is connected to the lock tongue, sawteeth are provided on the lock tongue, the sawteeth coordinates with a gear, the gear is connected to the lock case by using a bearing and a bearing seat, a poking spring is connected on the lock tongue, a limiting block is fixed on the lock case, and the poking spring is connected between the lock tongue and the limiting block.

Compared with the prior art, a rotor shaft of a vibration motor in the present invention is connected to an eccentric block, and a stage and the eccentric block are connected together. Curved reciprocating motion of the stage is achieved through eccentric motion, which has lower structural costs, a lower failure rate, and a longer service life than a motor in the prior art that drives, by using a belt, an eccentric main shaft to rotate. In a compression assembly, a cam and lock pieces are disposed in a pressure plate mounting bracket, and coordination between the lock pieces and teeth of a guiding shaft is released through rotation of the cam, so that a compression mounting bracket can freely slide up and down along the guiding shaft, thereby compressing a color paste bucket on the stage. For a double-door structure on a housing assembly, a side door and a side plate are connected together by using a side door assembly, an electric lock fixed on the side plate coordinates with a lock lug of the electric lock, to ensure that a side door is not opened when the mixer is operating, thereby improving security.

DESCRIPTION OF THE EMBODIMENTS

Figure 1:
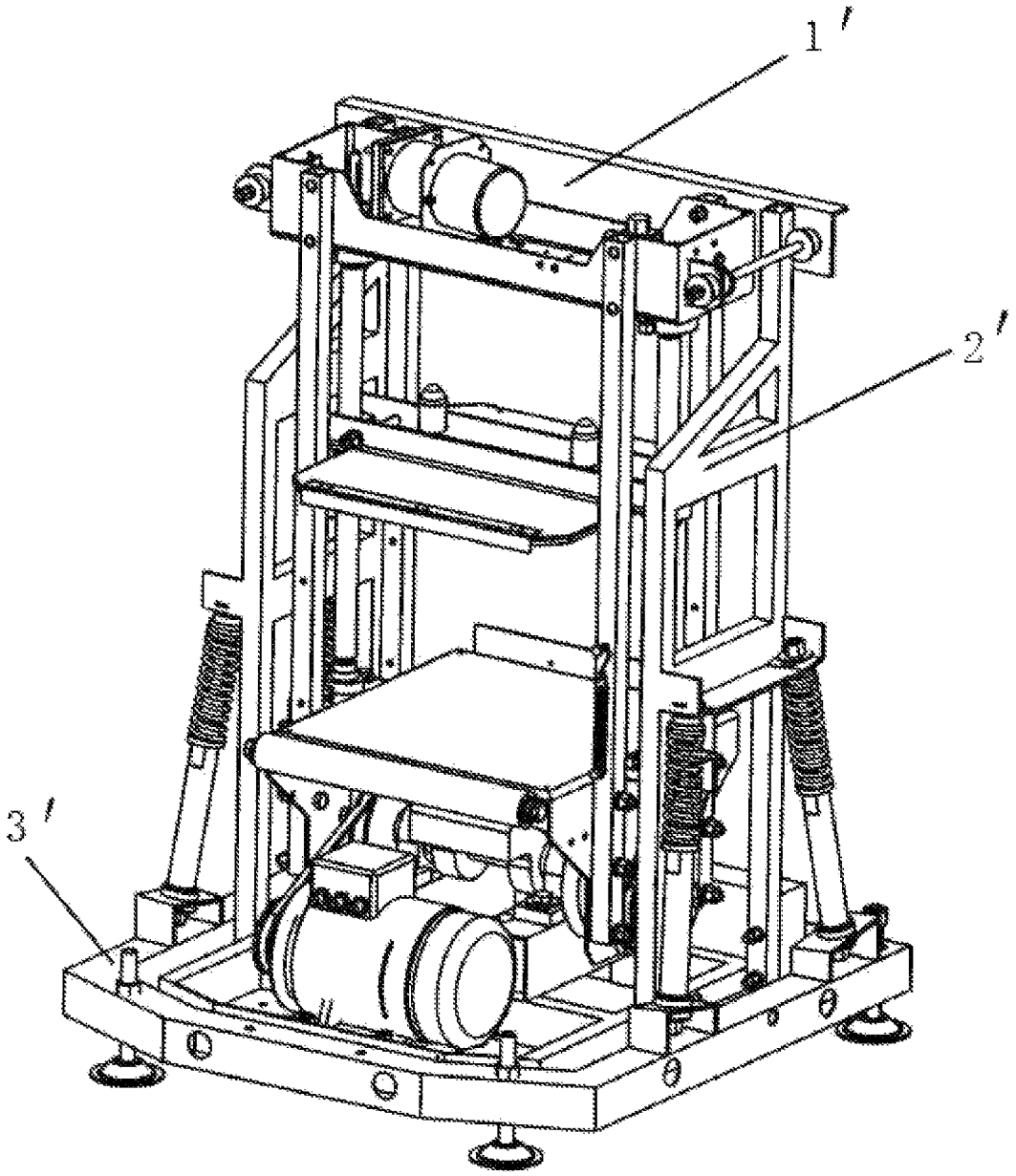
Prior Art Fig. 1
FIG. 1 is a schematic structural diagram of a vibration mixer in the prior art.
Figure 2:
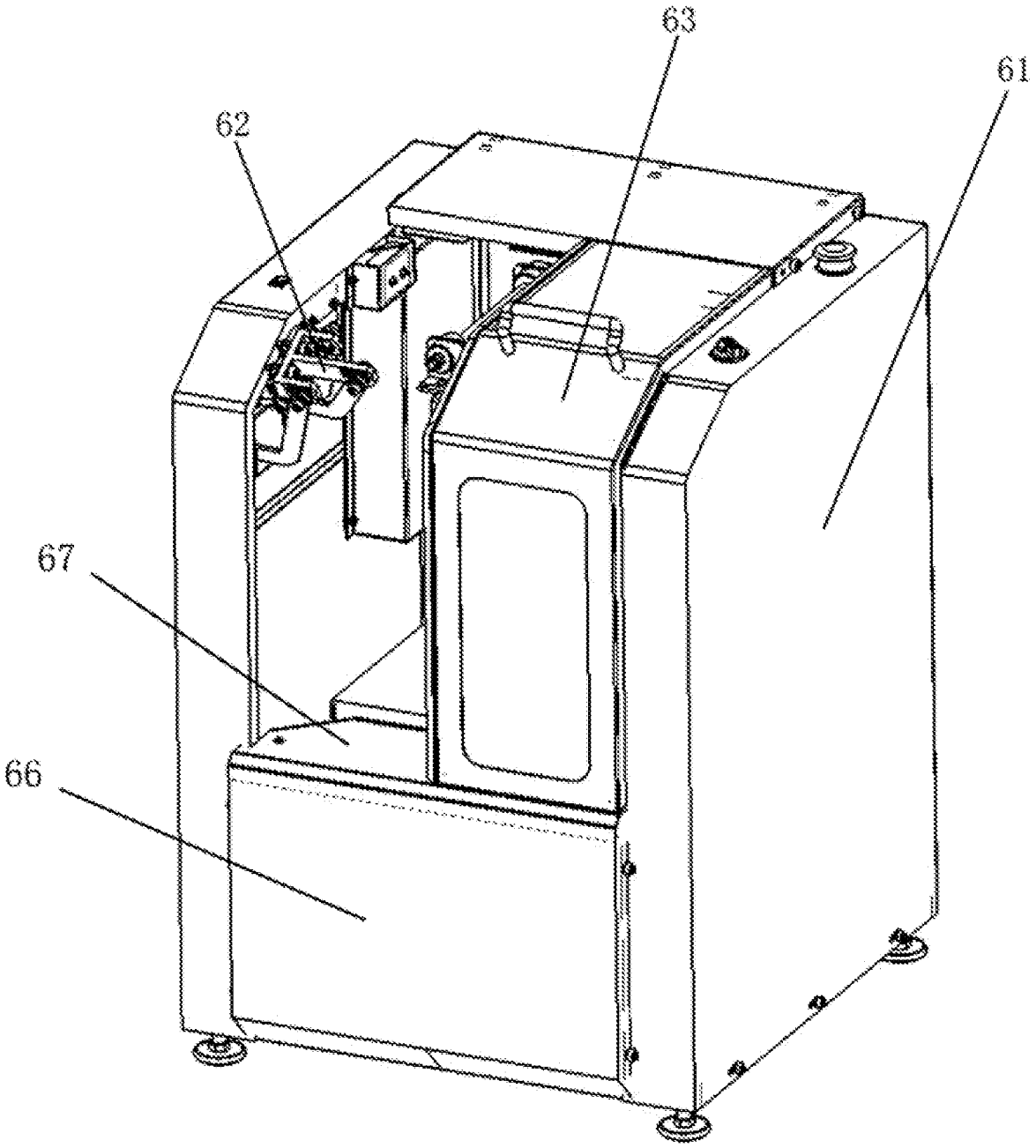
FIG. 2 is an overall schematic diagram of the present invention.
Figure 3:
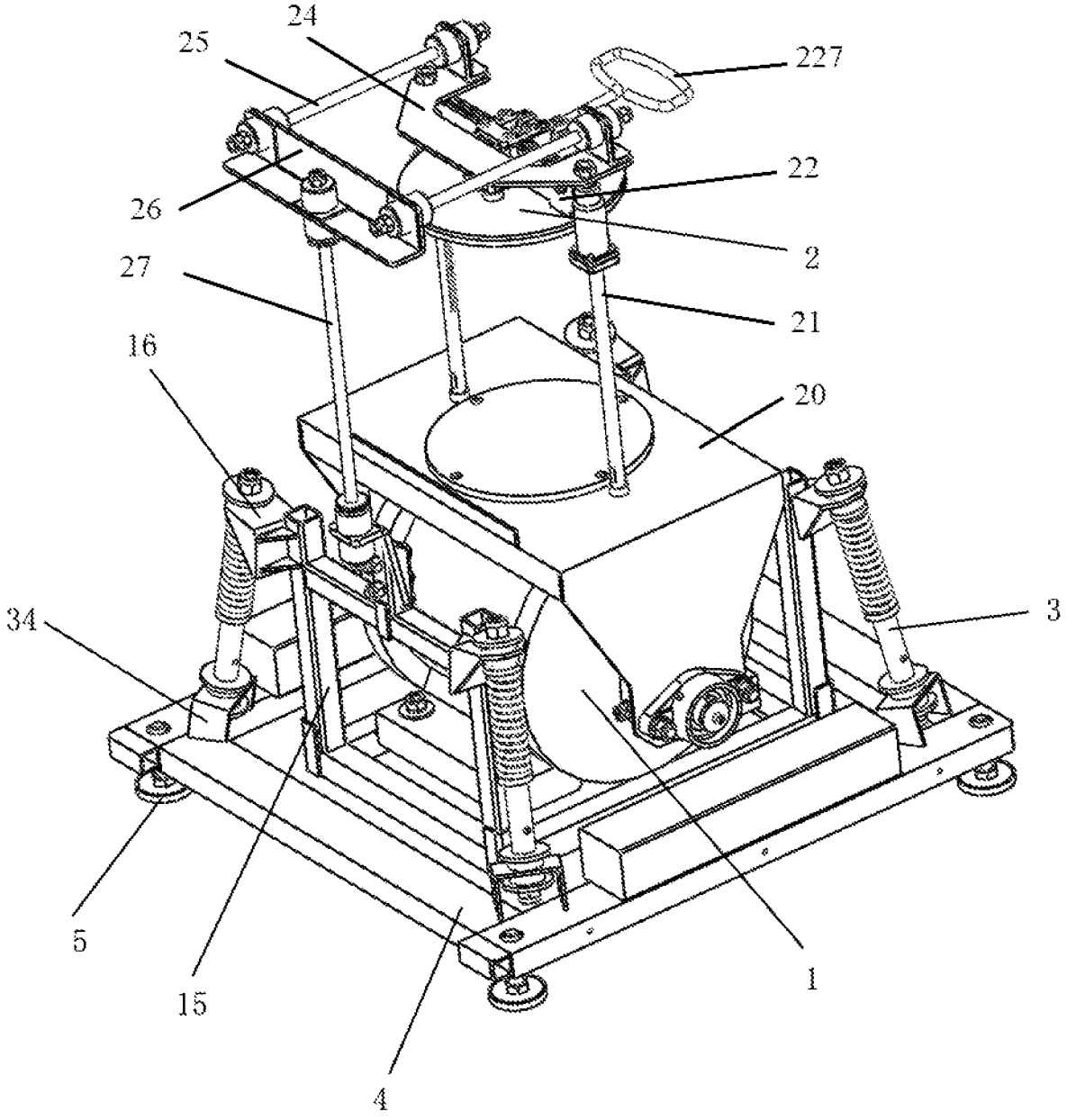
FIG. 3 is a schematic structural diagram of an inner core assembly according to the present invention.

As shown in FIG. 2 and FIG. 3, a vibration mixer is provided, including a housing assembly and an inner core assembly. The inner core assembly includes a motor assembly 1 and a compression assembly 2 located above the motor assembly 1. The motor assembly 1 includes a vibration motor 10, and a rotor shaft of the vibration motor 10 is connected to the compression assembly 2 by using an eccentric structure. The compression assembly 2 includes a stage 20, and the stage 20 is connected to a pressure plate mounting bracket 22 by using a guiding shaft 21. The pressure plate mounting bracket 22 is capable of sliding along the guiding shaft 21. The rotor shaft of the vibration motor 10 rotates and drives, by using the eccentric structure, the compression assembly 2 to perform reciprocating motion.

Figure 4:
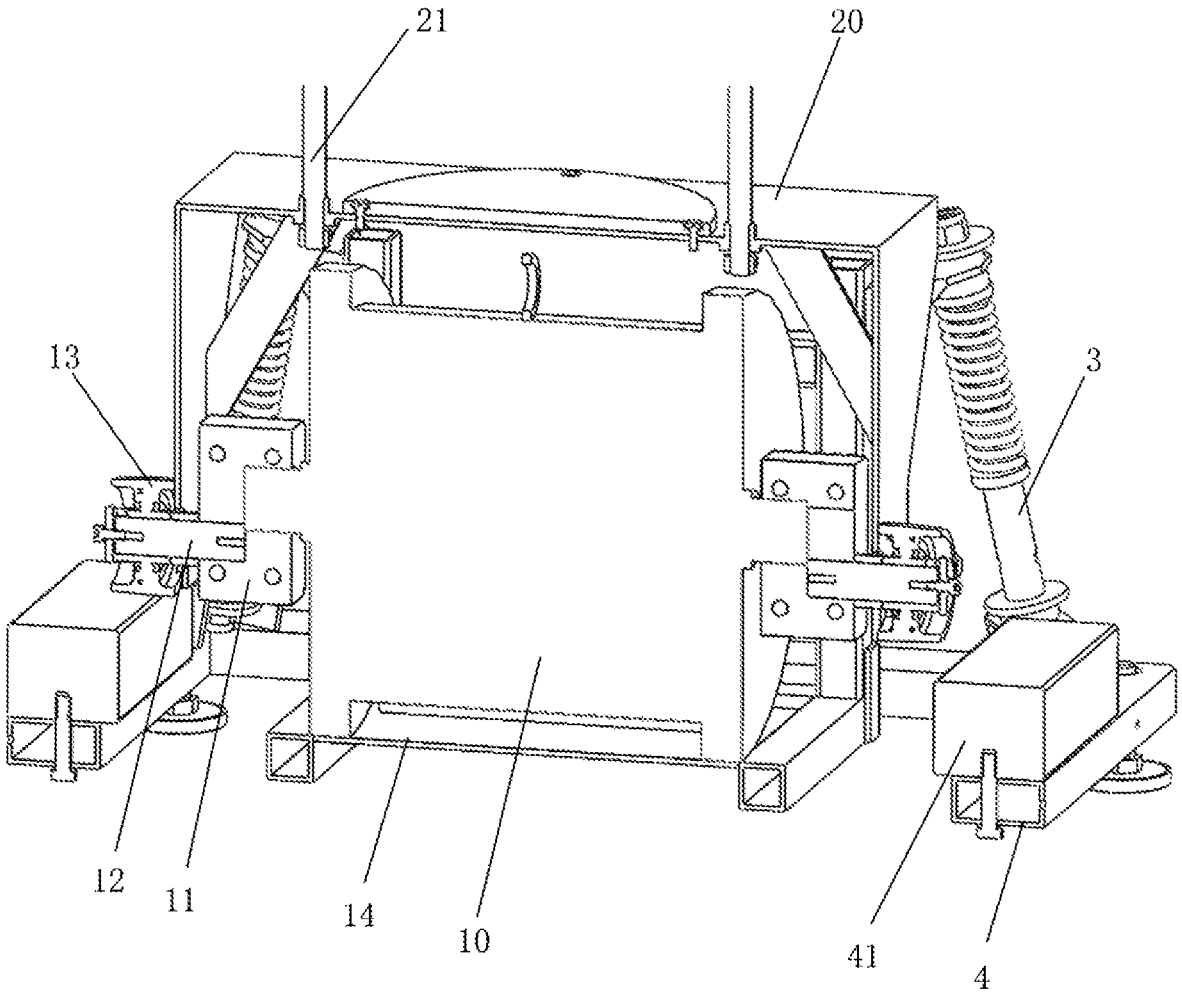
FIG. 4 is a schematic structural diagram of a motor assembly according to the present invention.
Figure 5:
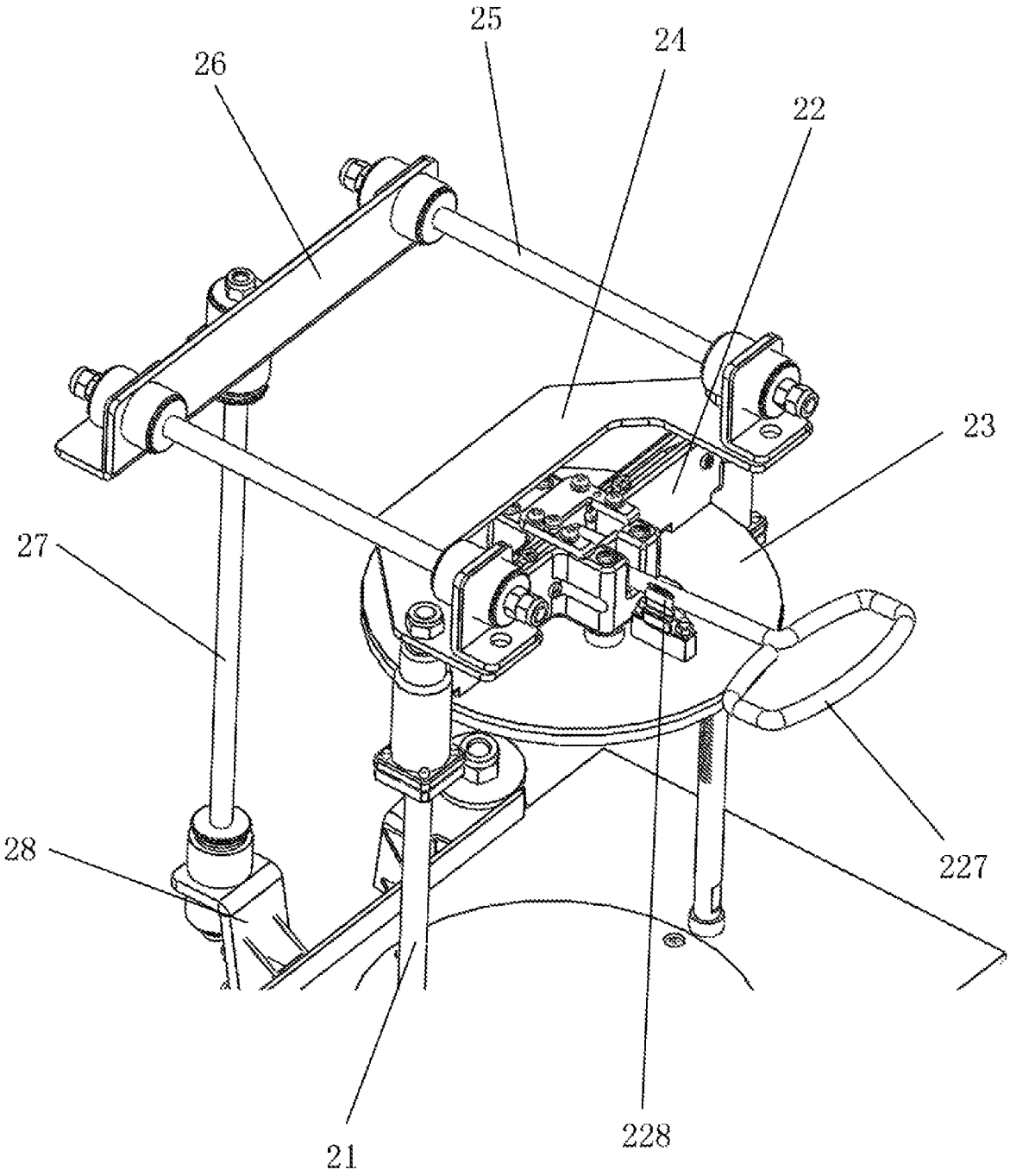
FIG. 5 is a schematic diagram of a connection between a connecting rod and a rear connecting rod according to the present invention.
Figure 6:
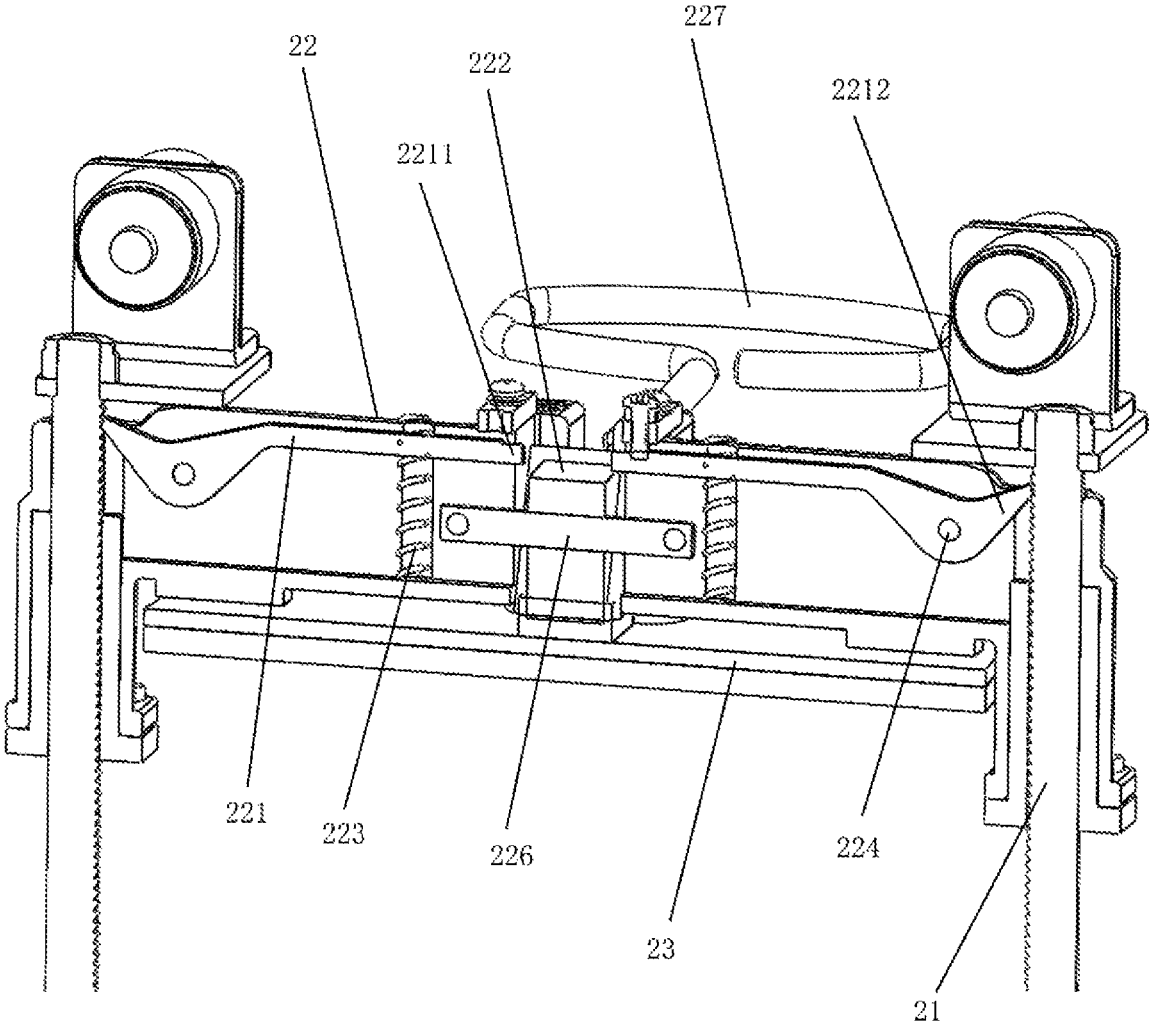
FIG. 6 is a schematic diagram of a cross-sectional structure of a compression assembly according to the present invention.
Figure 7:
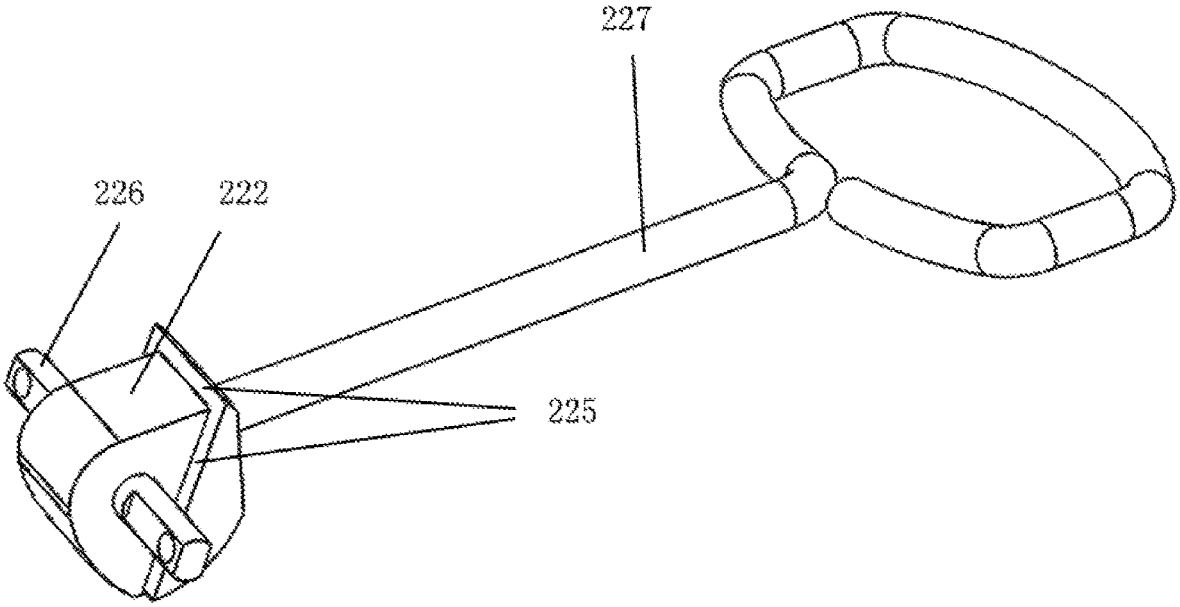
FIG. 7 is a schematic diagram of a connection between a cam and a cam handle and a connection between a cam and a cam shaft according to the present invention.
Figure 8:
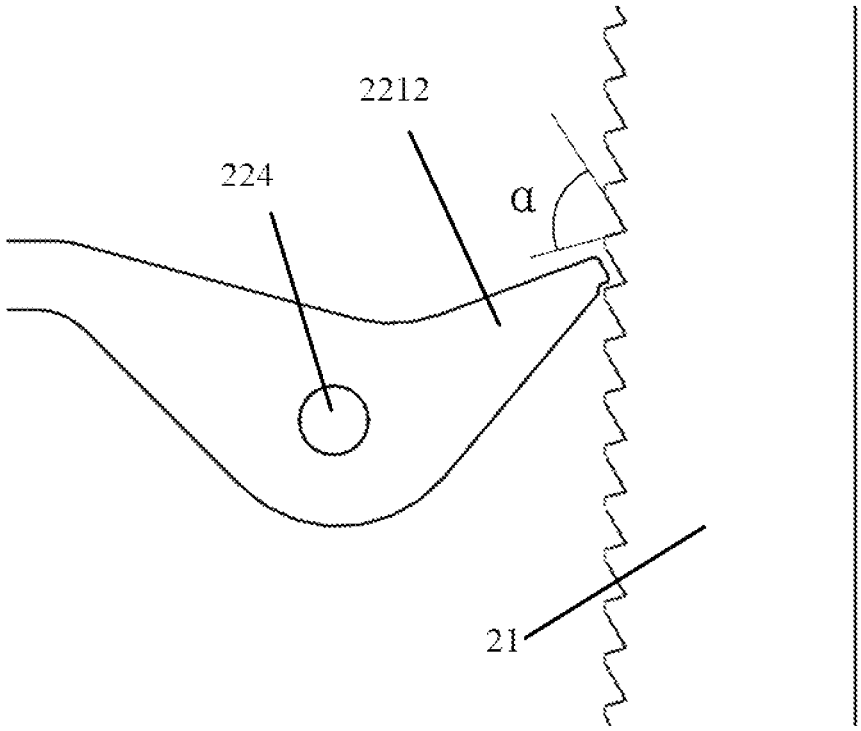
FIG. 8 is a schematic diagram of an enlarged structure of coordination between a lock piece and a guiding shaft according to the present invention.
Figure 9:
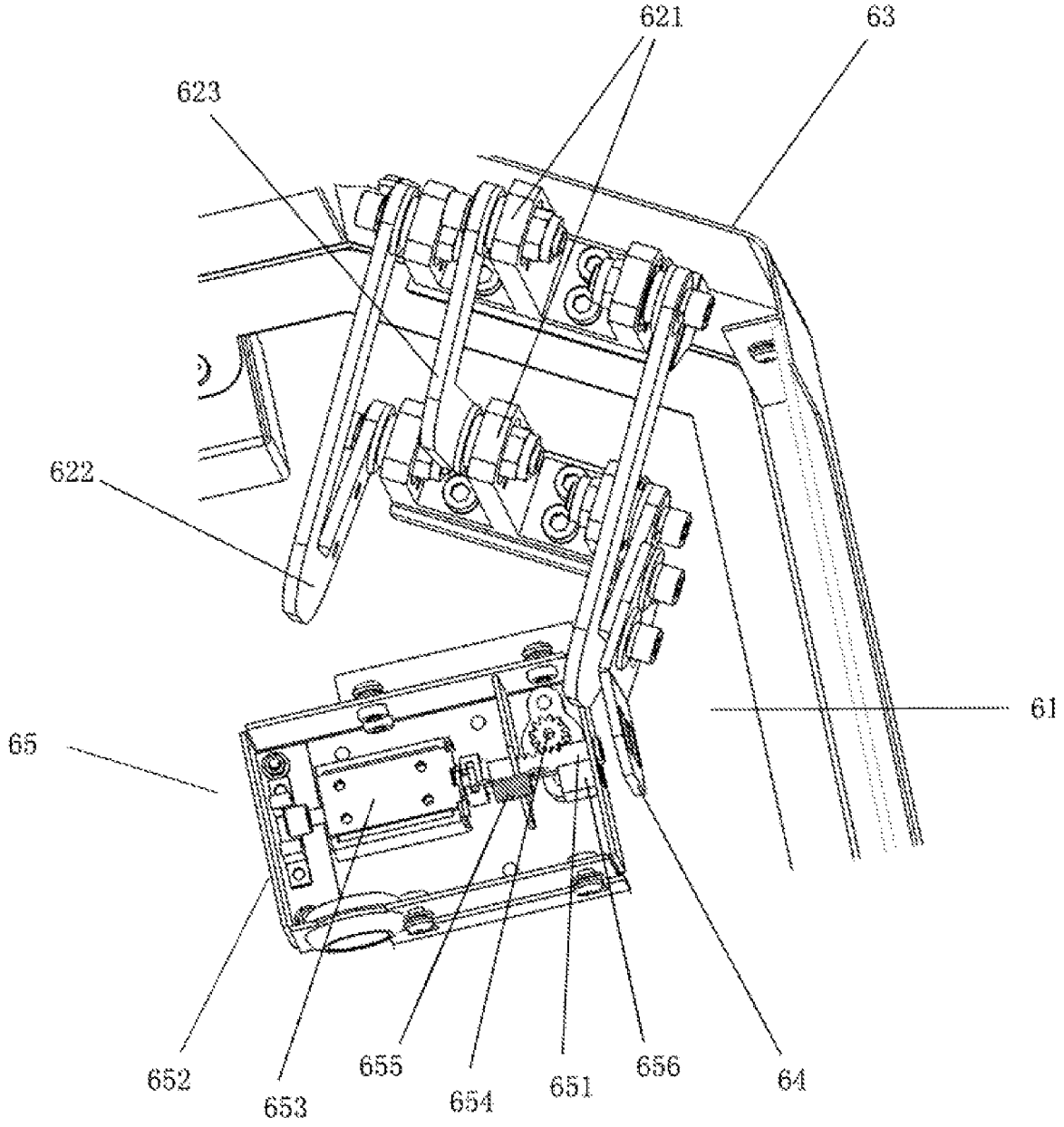
FIG. 9 is a schematic structural diagram of a side door assembly according to the present invention.
Figure 10:
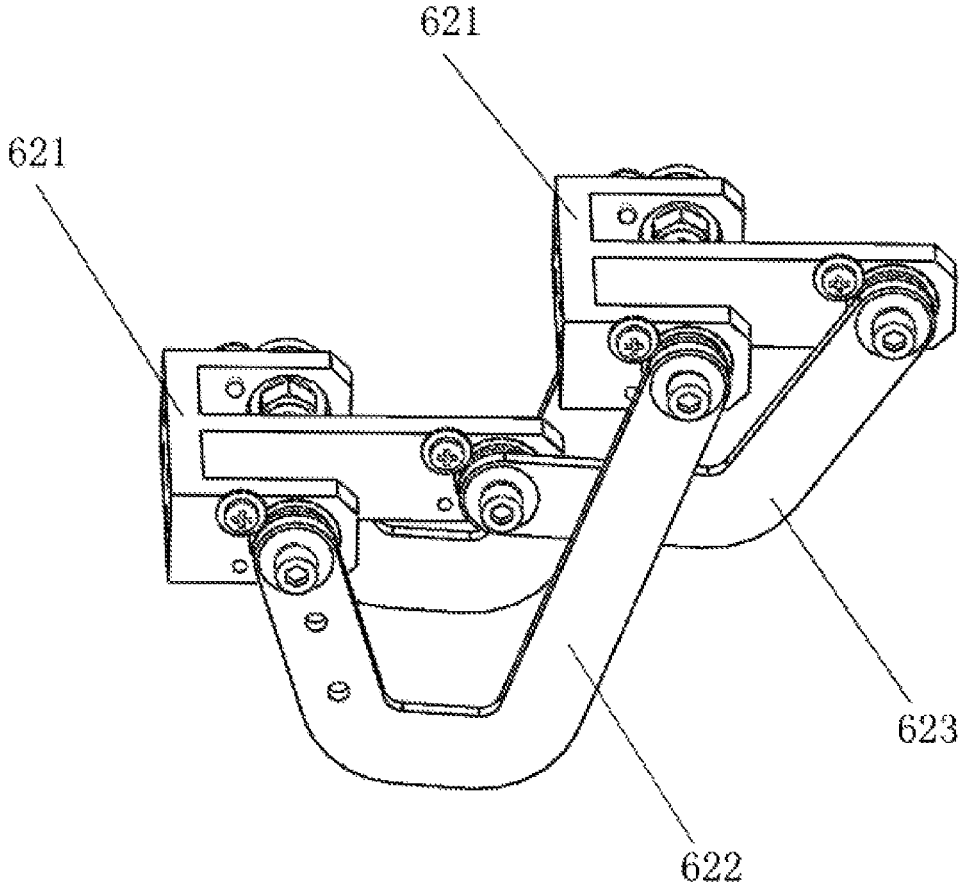
FIG. 10 is a schematic structural diagram of a side door assembly when a door is closed according to the present utility model.
Figure 11A:
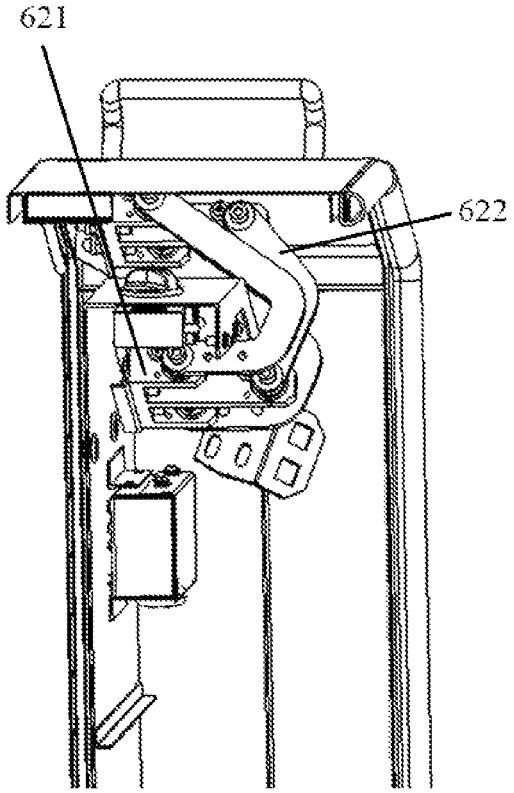
FIGS. 11A-B are a schematic structural diagrams of a connection between a side door assembly and a side door and a connection between a side door assembly and a side plate when a door is opened according to the present utility model.
Figure 11B:
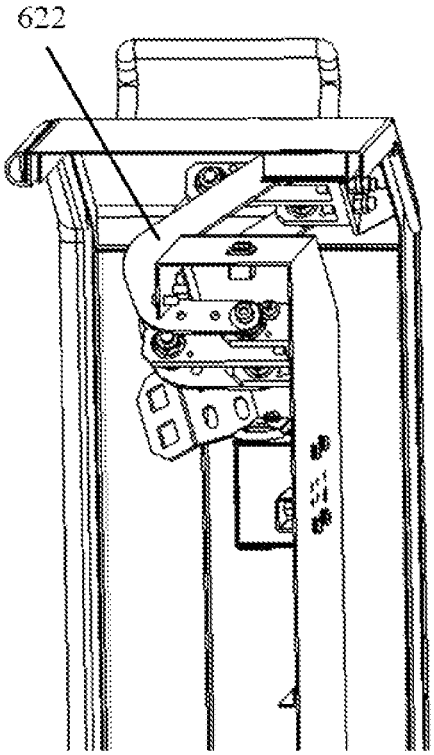
Figure 12:
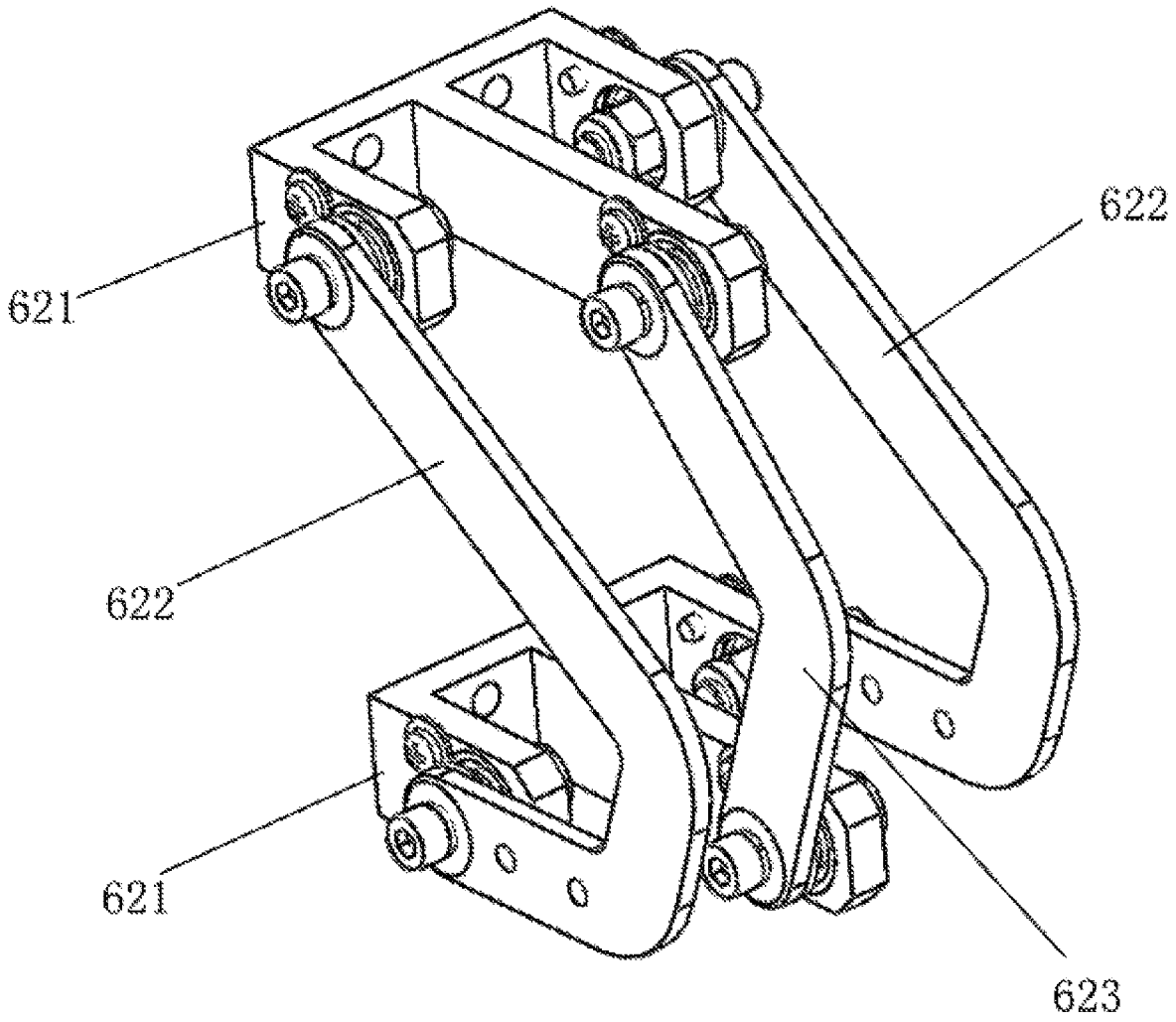
FIG. 12 is a schematic structural diagram of a side door assembly when a door is opened according to the present utility model.

As shown in FIG. 4, the eccentric structure is an eccentric block 11, two ends of the rotor shaft of the vibration motor 10 are both connected to the eccentric block 11, the eccentric block 11 is connected to an outer spherical bearing 13 with a vertical seat by using an eccentric pin shaft 12, the eccentric pin shaft 12 is located under an axis of the rotor shaft, a lower end of the stage 20 is connected to the outer spherical bearing 13 with the vertical seat by using a bolt, the stage and the eccentric block 11 are connected together by using the eccentric pin shaft 12 and the outer spherical bearing 13 with the vertical seat, and after the rotor shaft rotates, the eccentric block rotates together with the rotor shaft centering on the rotor shaft, so as to drive the stage to perform curved reciprocating motion, so that pastes in a color paste bucket is shaken and mixed. The guiding shaft 21 is connected to the pressure plate mounting bracket 22 by using a linear bearing, an upper pressure plate 23 is disposed above the stage 20, the upper pressure plate 23 is fixed on the pressure plate mounting bracket 22, a rubber pad is disposed on both the stage 20 and the upper pressure plate 23, and the pressure plate mounting bracket can slide up and down along the guiding shaft, so that the upper pressure plate 23 compresses or loosens the color paste bucket.

The motor assembly 1 further comprises motor fixing plate 14, the vibration motor 10 is fixed on the motor fixing plate 14, a vibration reduction column 15 is fixed at each vertex of the motor fixing plate 14, a vibration reduction support 16 is fixed at an upper end of the vibration reduction column 15, the vibration reduction support 16 is connected to a vibration reduction assembly 3, the vibration reduction assembly 3 is fixed to a base assembly 4, a connecting plate 24 is fixed above the pressure plate mounting bracket 22, a connecting rod 25 is fixed at each of two ends of a connecting plate 24, two connecting rods 25 are connected to an upper end portion of a rear connecting rod 27 by using a connecting rod fixing plate 26, a lower end portion of the rear connecting rod 27 is fixed on the vibration reduction column 15 by using a connecting rod bracket 28. The pressure plate mounting bracket 22 and the vibration reduction column 15 are connected together by using the connecting rod and the rear connecting rod. When the vibration motor is operating, the vibration reduction assembly connected to the vibration reduction column has a buffering effect on the stage.

Figure 13:
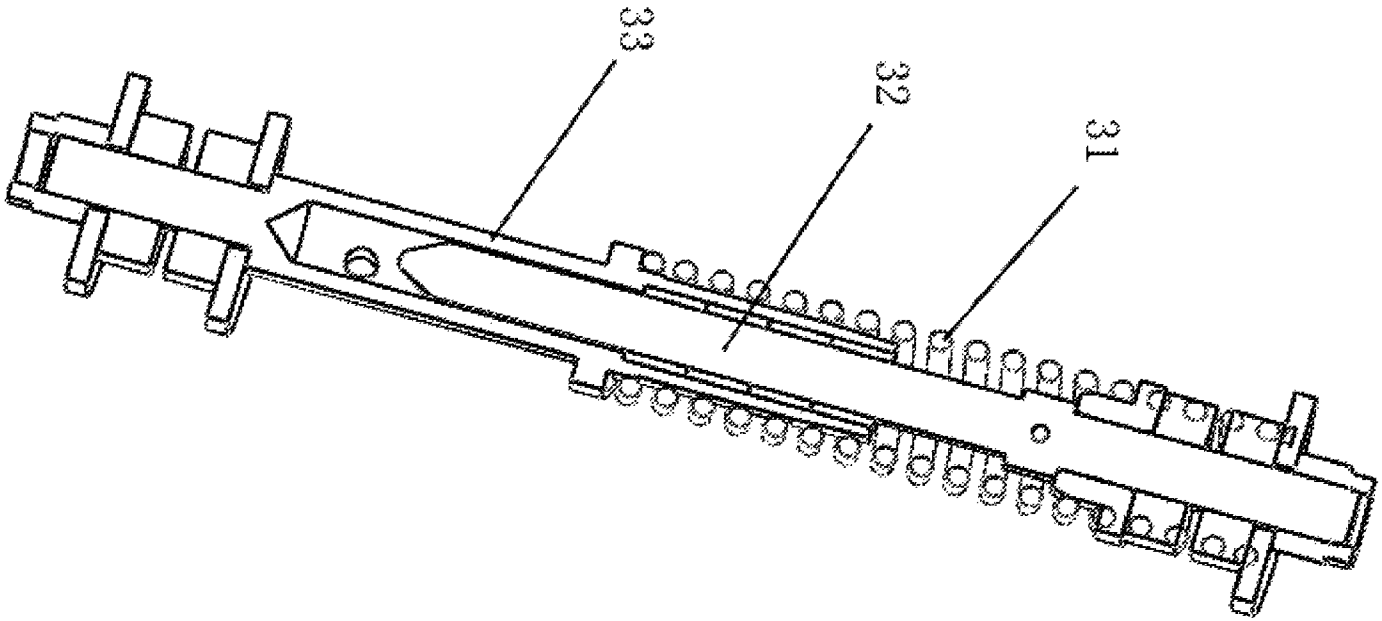
FIG. 13 is a schematic structural diagram of a vibration reduction assembly according to the present invention.

As shown in FIG. 2 and FIG. 13, the vibration reduction assembly 3 includes a vibration reduction pressure spring 31, a guiding column 32 is sleeved in the vibration reduction pressure spring 31, an upper end of the guiding column 32 is fixed on the vibration reduction support 16 by using a bolt, a bearing at a lower end of the guiding column 32 is connected to a pressure spring seat 33, a bolt of the pressure spring seat 33 is connected to a lower vibration reduction fulcrum bearing 34, and the lower vibration reduction fulcrum bearing 34 is fixed on the base assembly 4.

The base assembly 4 is a quadrangular frame structure formed by connecting metal pipes, the base assembly 4 is disposed on the ground by using machine feet 5, at least one clump weight block 41 is fixedly disposed on the base assembly 4, and the motor fixing plate 14 is located in the quadrangular frame of the base assembly 4.

As shown in FIG. 5 to FIG. 8, lock pieces 221 and a cam 222 are clamped in the pressure plate mounting bracket 22, the lock pieces 221 are symmetrically disposed on two sides of the cam 222, the lock piece 221 has an end I 2211 and an end II 2212, the end I 2211 is provided with an arc-shaped surface and is disposed towards the cam 222, the guiding shaft 21 is provided with teeth, the end II 2212 coordinates with the teeth, the lock piece close to a side of the end I 2211 is connected to a lock piece spring 223, the lock piece close to a side of the end II 2212 is connected to the pressure plate mounting bracket 22 by using a pin shaft 224. The teeth on the guiding shaft 21 are triangle sawteeth, and an angle $\alpha$ of the triangle sawtooth is 70° to 80°. Preferably, the angle of the triangle sawtooth is 75°, and the end II 2212 coordinates with the triangle sawtooth.

The cam 222 extends upwards and to two sides to form a convex edge 225, a cam shaft 226 penetrates through the cam 222, the cam shaft 226 is fixed on the pressure plate mounting bracket 22, a cam handle 227 is connected to the cam 222 in a vertical direction of the cam shaft 226, the cam handle 227 is clamped between two oppositely disposed clamp spring plates 228, and the clamp spring plates are fixed on an upper pressure plate 23.

The cam handle 227 is lifted, to drive the cam 222 to rotate around the cam shaft 226, until the convex edge 225 on the cam touches the end I 2211. Lifting the cam handle 227 upwards is continued, so that the convex edge presses the end I 2211 downwards, and the lock pieces rotate around the pin shaft 224. The end I 2211 is downward, and the end II 2212 tilts upwards, so that the end II 2212 is detached from the teeth of the guiding shaft 21, the locking effect of the lock pieces is released, and the pressure plate mounting frame can freely slide along the guiding shaft. After the pressure plate mounting bracket slides into place based on a height of a color paste bucket, the cam handle 227 is pressed downwards. After the convex edge 225 leaves the end I 2211, the end I 2211 is bounced under an action of the lock piece spring 223, so that the lock pieces return to an initial state. The end II 2212 coordinates to lock a location of the pressure plate mounting bracket in the teeth.

As shown in FIG. 9 to FIG. 12, the housing assembly includes side plates 61 located on two sides, and the side plate 61 is connected to a side door 63 on a corresponding side by using a side door assembly 62. Therefore, the housing assembly is applicable to a double-door structure of the mixer. The double-door structure includes a left-side door and a right-side door. A handle is fixedly connected to each of the left-side door and the right-side door, the left-side door is connected to a left-side plate by using the side door assembly 62, and the right-side door is also connected to a right-side plate by using the side door assembly 62. A lock lug 64 of an electric lock is fixed on the side door assembly 62, the electric lock 65 is fixed on the side plate 61, a lock tongue 651 is disposed on the electric lock 65, and the lock tongue 651 coordinates with the lock lug 64 of the electric lock. A lower baffle 66 is disposed under the side door 63, and a lower baffle pad 67 is fixedly connected to the lower baffle 66. In a process of placing a color paste bucket onto the stage, the lower baffle pad 67 can serve as a transition platform.

The side door assembly 62 includes double-door supports 621, the double-door supports 621 are fixed on both the side door 63 and the side plate 61, a U-shaped swing door connecting rod 622 and an L-shaped support bar 623 are connected between the two double-door supports 621, the two double-door supports 621 are connected to each of the swing door connecting rod 622 and the support bar 623 in a parallelogram mechanism, two swing door connecting rods 622 are disposed on two sides of the support bar 623, and the swing door connecting rod 622 close to the side door is fixedly connected to the lock lug 64 of the electric lock. The two swing door connecting rods 622 are disposed and are located on two sides of the support bar 623. The swing door connecting rod 622 close to a side of the side door is fixedly connected to the lock lug 64 of the electric lock. The two double-door supports 621 are connected to the U-shaped swing door connecting rod 622 and the L-shaped support bar 623 in a parallelogram mechanism, so that the side door remains in a horizontal state all along in a process of opening the side door. A connection between the swing door connecting rod 622 and the double-door support and a connection between the support bar 623 and the double-door support are both rotatable connections. The side door is pulled toward the side plate by using a handle, and the side door swings above the side plate through swinging of the connecting rod. Unlike an existing door structure in which a door rotates around a shaft, not only the door can be fully opened without affecting a field of vision and operations, but also the door does not easily swing back to affect the operations.

The electric lock 65 includes a lock case 652, an electromagnet 653 is disposed in the lock case 652, the electromagnet 653 is connected to the lock tongue 651, sawteeth are provided on the lock tongue 651, the sawteeth coordinate with a gear 654, the gear 654 is connected to the lock case 652 by using a bearing and a bearing seat, the lock tongue 651 is connected to a poking spring 655, a limiting block 656 is fixed on the lock case 652, and the poking spring 655 is connected between the lock tongue 651 and the limiting block 656. After the electric lock is powered on, the electromagnet 653 generates an electromagnetic effect, and the lock tongue 651 is pushed out and inserted into the lock lug 64 of the electric lock to achieve the effect that the side door cannot be opened when the machine is operating. In this case, because the lock tongue extends to enable the poking spring 655 to be in a compressed state, after the electric lock is powered off, a magnetic field disappears, and the lock tongue is returned due to elastic force of the poking spring 655, the side door 63 is unlocked, and the side door is smoothly opened.

An operating procedure of the present invention is as follows: The side door is opened, the side door is in a double-door form, and when the side door is opened, either side may be randomly opened, or both sides are opened. The color paste bucket is placed on the stage, and the cam handle 227 is first lifted to release coordination between the lock pieces and the guiding shaft 21. After the pressure plate mounting bracket slides downwards along the guiding shaft and stays on the color paste bucket, the cam handle 227 is pressed downwards to lock the location of the pressure plate mounting bracket, and the color paste bucket is compressed through coordination between the upper pressure plate 23 and the stage 20. The rubber pads disposed on the upper pressure plate 23 and the stage 20 can cushion friction between the color paste bucket and the upper pressure plate, and friction between the color paste bucket and the stage. After the color paste bucket is placed, the side door is closed. After being powered on, the vibration motor starts to operate, and the rotor shaft of the vibration motor drives the eccentric block to rotate around the rotor shaft. The connection between the eccentric pin shaft on the eccentric block and the eccentric block is a rotatable connection. In a process in which the eccentric block rotates, the stage remains in a horizontal state all along, the stage follows the eccentric pin shaft to perform curved up-and-down reciprocating motion, and a material in the color paste bucket is subjected to oscillating force to achieve uniformity.

The foregoing descriptions are only preferred implementations of the present invention. It should be noted that a person skilled in the art can make several modifications and improvements without departing from the overall concept of the present invention, and these modifications and improvements shall all be considered as the protection scope of the present invention.

What is claimed:

1. An inner core assembly for a vibration mixer, comprising a motor assembly and a compression assembly located above the motor assembly, wherein the motor assembly comprises a vibration motor, a rotor shaft of the vibration motor is connected to the compression assembly by using an eccentric structure, the compression assembly comprises a stage, the stage is connected to a pressure plate mounting bracket by using a guiding shaft, the pressure plate mounting bracket is capable of sliding along the guiding shaft, the rotor shaft of the vibration motor rotates and drives, by using the eccentric structure, the compression assembly to perform reciprocating motion, wherein the eccentric structure is an eccentric block, two ends of the rotor shaft of the vibration motor are both connected to the eccentric block, the eccentric block is connected to an outer spherical bearing with a vertical seat by using an eccentric pin shaft, the stage is connected to the outer spherical bearing with the vertical seat, the guiding shaft is connected to the pressure plate mounting bracket, an upper pressure plate is disposed above the stage, and the upper pressure plate is fixed on the pressure plate mounting bracket.

2. The inner core assembly for the vibration mixer according to claim 1, wherein the motor assembly further comprises a motor fixing plate, the vibration motor is fixed on the motor fixing plate, a vibration reduction column is fixed at each vertex of the motor fixing plate, a vibration reduction support is fixed at an upper end of the vibration reduction column, the vibration reduction support is connected to a vibration reduction assembly, the vibration reduction assembly is fixed on a base assembly, a connecting plate is fixed above the pressure plate mounting bracket, a connecting rod is fixed at each of two ends of a connecting plate, two connecting rods are connected to an upper end portion of a rear connecting rod by using a connecting rod fixing plate, a lower end portion of the rear connecting rod is fixed on the vibration reduction column by using a connecting rod bracket.

3. The inner core assembly for the vibration mixer according to claim 2, wherein the vibration reduction assembly comprises a vibration reduction pressure spring, a guiding column is sleeved in the vibration reduction pressure spring, an upper end of the guiding column is fixed on the vibration reduction support by using a bolt, a bearing at a lower end of the guiding column is connected to a pressure spring seat, a bolt of the pressure spring seat is connected to a lower vibration reduction fulcrum bearing, and the lower vibration reduction fulcrum bearing is fixed on the base assembly.

4. The inner core assembly for the vibration mixer according to claim 2, wherein the base assembly is a quadrangular frame structure formed by connecting metal pipes, the base assembly is disposed on the ground by using machine feet, at least one clump weight block is fixedly disposed on the base assembly, and the motor fixing plate is located in the quadrangular frame of the base assembly.

5. The inner core assembly for the vibration mixer according to claim 1, wherein lock pieces and a cam are clamped in the pressure plate mounting bracket, the lock pieces are symmetrically disposed on two sides of the cam, the pressure plate mounting bracket is connected to the guiding shaft, teeth are provided on the guiding shaft, one end of the lock piece is disposed towards the cam, and the other end coordinates with the teeth of the guiding shaft.

6. The inner core assembly for the vibration mixer according to claim 5, wherein the teeth on the guiding shaft are triangle sawteeth, and an angle $\alpha$ of the triangle sawtooth is 70° to 80°.

7. The inner core assembly for the vibration mixer according to claim 5, wherein the lock piece has an end I and an end II, the end I is provided with an arc-shaped surface and is disposed towards the cam, the end II coordinates with the teeth, the lock piece close to a side of the end I is connected to a lock piece spring, the lock piece close to a side of the end II is connected to the pressure plate mounting bracket by using a pin shaft.

8. The inner core assembly for the vibration mixer according to claim 5, wherein the cam extends upwards and to two sides to form a convex edge, a cam shaft penetrates through the cam, the cam shaft is fixed on the pressure plate mounting bracket, a cam handle is connected to the cam in a vertical direction of the cam shaft, the cam handle is clamped between two oppositely disposed clamp spring plates, and the clamp spring plates are fixed on an upper pressure plate.

9. A vibration mixer including an inner core assembly of claim 1, comprising:

a housing assembly; and the inner core assembly of claim 1.

10. The vibration mixer according to claim 9, wherein the housing assembly comprises side plates located on two sides, the side plate is connected to a side door on a corresponding side by using a side door assembly, a lock lug of an electric lock is fixed on the side door assembly, the electric lock is fixed on the side plates, a lock tongue is disposed on the electric lock, the lock tongue coordinates with the lock lug of the electric lock, a lower baffle is disposed under the side door, and a lower baffle pad is fixedly connected to the lower baffle.

11. The vibration mixer according to claim 10, wherein the side door assembly comprises double-door supports, the double-door supports are fixed on both the side door and the side plates, a U-shaped swing door connecting rod and an L-shaped support bar are connected between the two double-door supports, the two double-door supports are connected to each of the swing door connecting rod and the support bar in a parallelogram mechanism, two swing door connecting rods are disposed on two sides of the support bar, and the swing door connecting rod close to the side door is fixedly connected to the lock lug of the electric lock.

12. The vibration mixer according to claim 10, wherein the electric lock comprises a lock case, an electromagnet is disposed in the lock case, the electromagnet is connected to the lock tongue, sawteeth are provided on the lock tongue, the sawteeth coordinates with a gear, the gear is connected to the lock case by using a bearing and a bearing seat, a poking spring is connected on the lock tongue, a limiting block is fixed on the lock case, and the poking spring is connected between the lock tongue and the limiting block.

* * * * *